United States Patent [19]

Deaton

[11] 4,078,805

[45] Mar. 14, 1978

[54] METHOD OF PLAYING A GAME

[76] Inventor: Charles U. Deaton, Genessee Mountain, Golden, Colo. 80401

[21] Appl. No.: 690,007

[22] Filed: May 26, 1976

[51] Int. Cl.[2] ..... A63F 3/00

[52] U.S. Cl. ..... 273/275

[58] Field of Search ..... 273/130 R, 135 R, 135 AA, 273/135 AC, 134 GA, 134 GB, 131 B, 131 AB, 157 R, 137 C, 137 D, 152 R

[56] References Cited

U.S. PATENT DOCUMENTS

| | | | |
|---|---|---|---|
| 2,162,876 | 6/1939 | Barton | 273/131 B |
| 2,806,702 | 9/1957 | Baker | 273/135 AC |
| 3,309,092 | 3/1967 | Hardesty et al. | 273/137 D |
| 3,649,023 | 3/1972 | Schohn | 273/135 AC |
| 3,695,615 | 10/1972 | Shoptaugh | 273/130 R |
| 3,820,791 | 6/1974 | Powers | 273/131 B |
| 3,860,241 | 1/1975 | Leftin | 273/131 B |

FOREIGN PATENT DOCUMENTS

| | | | |
|---|---|---|---|
| 512,544 | 9/1939 | United Kingdom | 273/152 R |
| 621,430 | 4/1949 | United Kingdom | 273/137 C |
| 627,425 | 8/1949 | United Kingdom | 273/137 D |
| 694,880 | 7/1953 | United Kingdom | 273/134 GA |
| 633,951 | 12/1949 | United Kingdom | 273/157 R |

*Primary Examiner*—Richard C. Pinkham
*Assistant Examiner*—Harry G. Strappello
*Attorney, Agent, or Firm*—Horace B. Van Valkenburgh; Frank C. Lowe

[57] ABSTRACT

The game board has playing squares, across or on some of which are placed a river or stream, a railway, mountains or other topographical features. A first set of playing pieces have indicia representing a primary function, such as a town, and a secondary function, such as one or more access roads for the town and leading to one or more of the sides of the playing piece. The first set of playing pieces is provided, on the back, with a mark which distinguishes the first set, when upside down, from the second and third sets. Pieces of the first set are placed at random upside down on the playing board. The second set of pieces have indicia representing a function correlated with the function of the first set of pieces, such as roads extending from the center to one or more sides of the playing piece, and are playable in abutment to pieces of the first set. The third set of pieces have indicia representing a portion of a river or stream, a railway or a mountain, with additional representations of a bridge for the stream, an overpass for the railway and a tunnel for the mountain. The third set of pieces are playable on the squares on which the topographical features are represented.

The first set of pieces, while placed at random upside down on the board, are to be turned over in the manner of turning the pages of a book, or in the manner of turning over pages of a tablet, i.e., without disturbing one axis of the indicia on the piece. This creates an element of chance, in addition to the elements of chance in the random placement of a first type of piece on the board, the random placement of the indicia axes of those pieces on the board and the drawing of pieces. Scores are made by completing the building of a road connecting two towns.

10 Claims, 22 Drawing Figures

METHOD OF PLAYING A GAME

This invention relates to a method of playing a game involving a playing board and normally different sets or types of pieces played thereon.

Numerous games having a board or playing space divided into squares are known. Also, games in which certain types of playing pieces are placed on selected squares to provide a continuation of a line or marking on the respective piece, as in Doty U.S. Pat. No. 471,666 or Barton U.S. Pat. No. 2,162,876, are known. Games involving an additional type of playing piece, the playing position of which is determined by the placement of pieces of the first type, are also known. However, many of the games involving the placement or movement of playing pieces depend upon numbers determined by chance through rolling dice or a spinner. In addition, numerous games depend upon drawing or receiving different types of instructions, as in Darrow U.S. Pat. No. 2,026,082. The game of the present invention relies not only on chance in the distribution of the playing pieces, particularly a first type of playing piece, as well as the placing of a second type of playing piece in a particular relationship to the first type, but also an interrelationship between the position of a first type of playing piece, as placed, to second and third types of playing pieces. In additional, there are special playing pieces, i.e., the third type, which may be played only in relationship to a feature represented on the playing board, normally in conjunction with a second type of playing piece.

For the method of the present invention, i.e., the game entitled "Country Road", the playing board is divided into squares, with topographical features, such as railways, rivers or streams and mountains represented thereon. A first type of playing piece is known as a "town" piece, since it has a representation of a town, together with one or more access roads leading out of town to a corresponding edge of the piece. Each "town" piece is initially placed upside down on the playing board, so that the number and direction of the access road or roads will be known only when the "town" piece is turned over, during play. A second type of playing piece is known as a "road" piece, on which is represented different road locations or intersections. The road pieces are playable abutting the town pieces to form continuations of an access road leading from the town. It is the direction of the access road or roads of the respective "town" pieces, when turned over, which constitutes an additional element of chance. A third type of playing piece is a special piece having a road representation but playable only on a square which is traversed by a river or stream, or a railway or occupied by a representation of a mountain. The playing pieces which are playable with such topographical features include pieces having an overpass for the railway, a bridge for the river or stream or a tunnel for the mountain.

The method of this invention involves a first set of pieces having directional indicia on one side and a second set of pieces having directional indicia related to the directional indicia of pieces of the first set, with the first pieces initially being placed at random on spaces of the board with the indicia downward. The method includes turning over each first piece on the same playing space without disturbing one axis of direction of the indicia.

The foregoing and additional features of this invention will become apparent from the following description, taken in conjunction with the accompanying drawings, in which.

Figure 1:
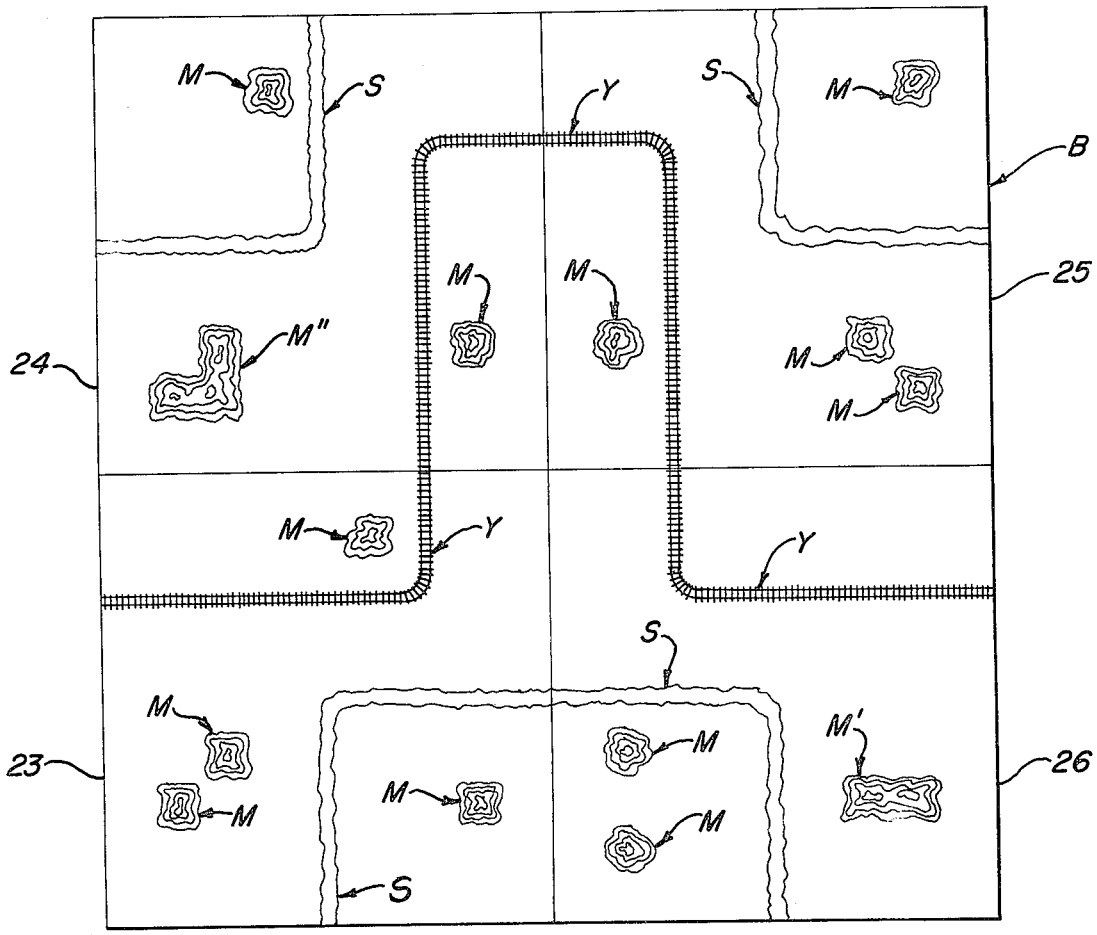
FIG. 1 is a top plan view of the game board, on a reduced scale.
Figure 3:
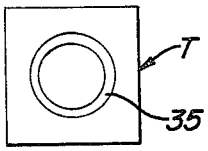
FIG. 3 is a plan view of the bottom or reverse side of a first type of playing piece, i.e., a "town" piece, adapted to occupy any one of a large number of spaces on the board.
Figure 6:
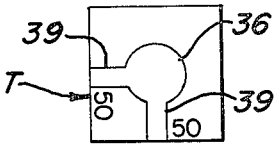
FIGS. 4–9 are plan views of the top sides of a series of playing pieces, i.e., the first type and thus having the same marking, as in FIG. 3, on the bottom or reverse side.
Figure 9:
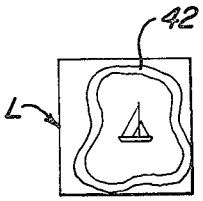
Figure 2:
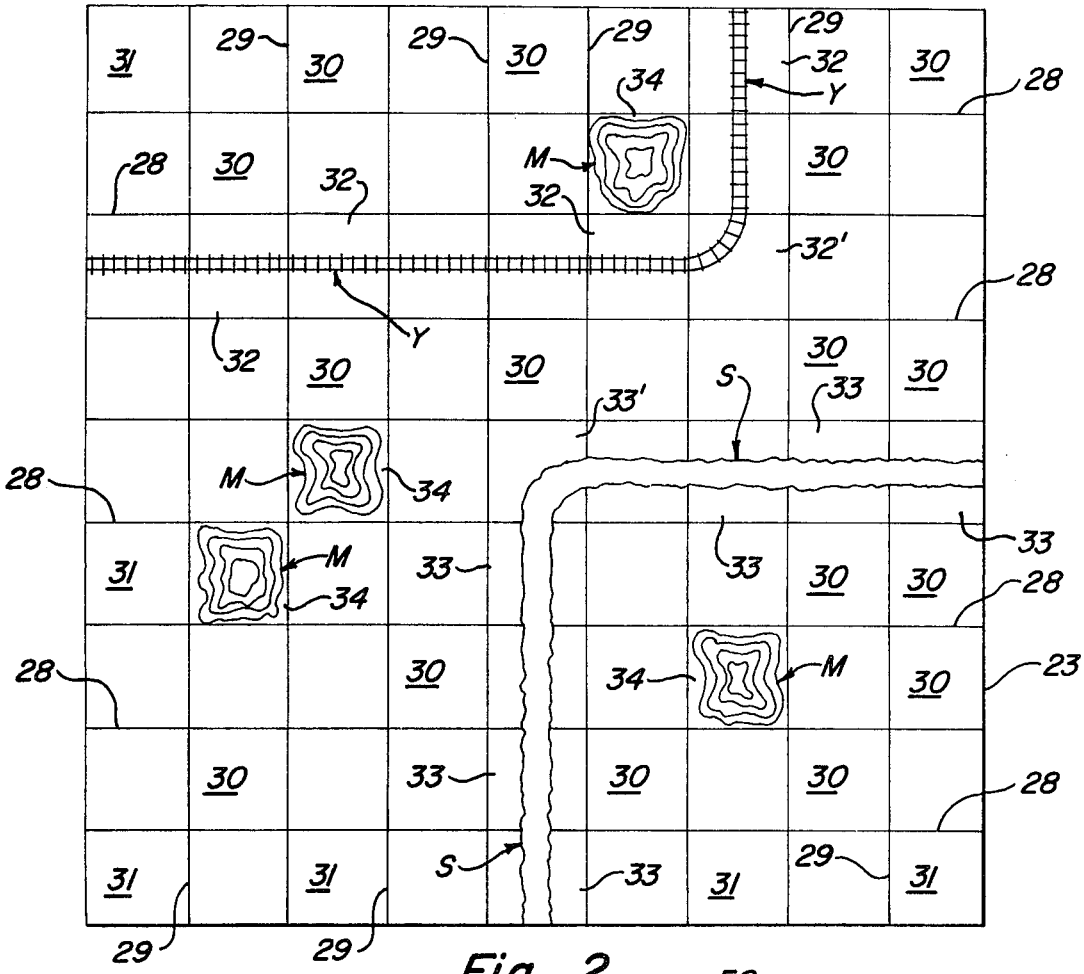
FIG. 2 is a top plan view, on an enlarged scale, of one quadrant of the game board of FIG. 1, showing also the lines which divide the board into playing spaces.

As illustrated in FIG. 1, a board B adapted for use in playing a game in accordance with this invention may be a single board, a single board hinged in the middle, or a series of boards which fit together in any suitable manner. One example is the board shown, comprising quadrants 23, 24, 25 and 26. On the board is represented several railway tracks Y, several rivers or streams S, and various mountains M, M′ and M″. As shown in FIG. 2, which is an enlargement of the quadrant 23 for convenience of illustration, the board is divided by parallel, equally spaced, horizontal lines 28 and parallel, similarly equally spaced, vertical lines 29 into square playing spaces, a majority being spaces 30. Playing spaces 31 occupy the outer edges of the playing board and are separately identified, for a purpose described later. Thus, playing spaces 31 are located along the left edge and the bottom of quadrant 23, since the upper edge abuts quadrant 24 and the right edge abuts quadrant 26. Spaces 32 are traversed by a railway Y and spaces 33 by a stream S, while a space 34 is occupied by a mountain M. The mountains M normally occupy a single playing space, although it will be noted that mountain M′ of quadrant 26 occupies two playing spaces, while mountain M″ of quadrant 24 occupies three playing spaces. Space 32′ is traversed by a curve of the railway, while a space 33′ is traversed by a bend of the stream S. It will be understood, of course, that representations of the streams, railways and mountains may be different from those shown. Also, other natural or man-made features, such as canals, harbors, seas, oceans, subways, primitive areas, parks, airports, wildlife and other game preserves, flyways, trails, ski areas, Indian reservations, cattle trails, pipelines, tundra, sled trails, super highways, and others, may be substituted for one or more of the features of the embodiment shown and may be varied in combination.

Figure 10:
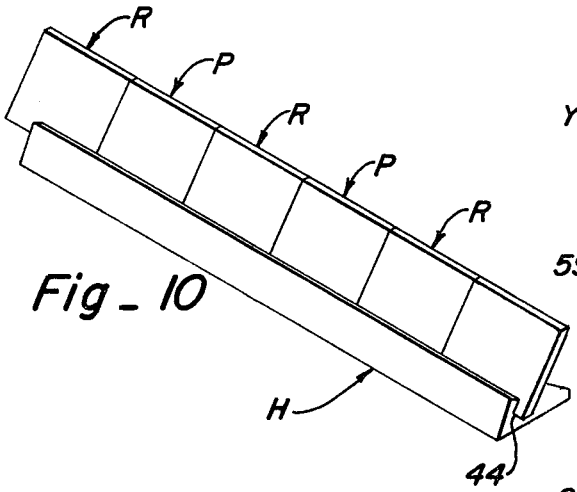
FIG. 10 is a perspective view of a holder for a number of playing pieces, one holder being available for use by each of the players.

One set or type of playing pieces, which are preferably rectangular and correspond in size to the playing spaces, comprise the town pieces T. These town pieces bear insignia on the bottom, such as circle 35 of FIG. 3, to distinguish the town pieces T of FIGS. 3–8 from the road pieces R of FIGS. 11–13 and the special pieces P of FIGS. 16–21. On the front or upper side, the town pieces T of FIGS. 3–8 are each provided with a circular representation 36 of the location of a town, with respective indications of access roads leading to and from the town, i.e. one road 37 of FIG. 4, opposite roads 38 of FIG. 5, 90° roads 39 of FIG. 6, three roads 40 of FIG. 7 and four roads 41 of FIG. 8. It will be noted that there are several of each of the different road pieces. Each lake piece L, having a representation 42 of a lake and a representation of a sailboat on the lake, has the same insignia, such as circle 35 of FIG. 3, on the bottom or rear as the town pieces T and is placed, along with the town pieces, in the manner hereinafter described. The playing pieces to be drawn by each of the players, in turn, in a manner described below, include a second type or set, i.e., the road pieces R of FIGS. 11–15, and a third type or set, i.e., the special pieces P of FIGS. 16–21, which are both identical on the bottom or reverse side, such as having no insignia thereon and thus distinguishing from the town pieces T. A suitable holder H of FIG. 10 is utilized to store the road pieces R and special pieces P of the individual player, being truncated and provided with a groove 44 in which the playing pieces may be stored until the respective player desires to play or discard one of them.

Figure 13:
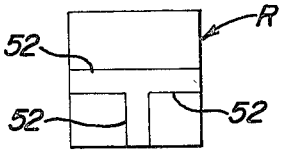
FIGS. 11–15 are plan views of the top sides of a second type of playing piece, i.e. a "road" piece.
Figure 4:
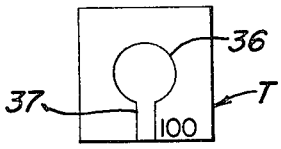
Figure 7:
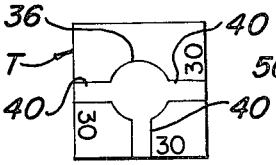
Figure 11:
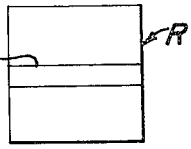
Figure 14:
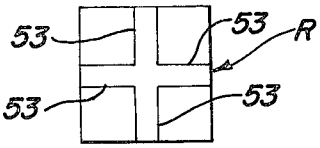
Figure 5:
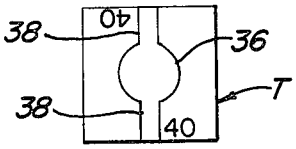
Figure 8:
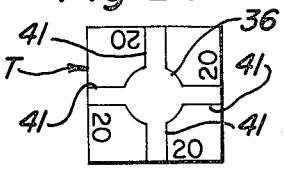
Figure 12:
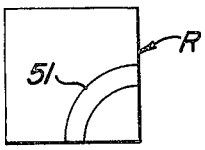
Figure 15:
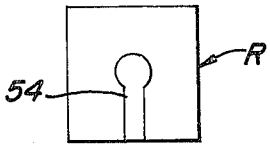

The road pieces R include those of FIG. 11 on which a crossroad 50 extends between two opposite sides, those of FIG. 12 on which a curved road 51 extends between adjacent sides, those of FIG. 13 having three intersecting roads 52 extending from the center to three sides and those of FIG. 14 having roads 53 extending from the center to each of the four sides of the piece. Another road piece R, that of FIG. 15, is provided with a road 54 which extends merely to a small circle in the center of the piece and is referred to as a "dead end" road piece.

Figure 16:
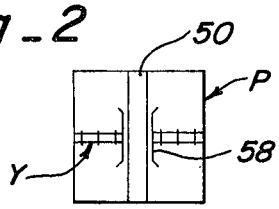
FIGS. 16–21 are plan views of a third type of playing piece, i.e., a "special" piece.
Figure 19:
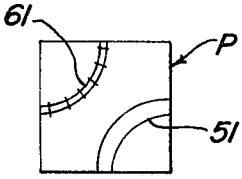
Figure 17:
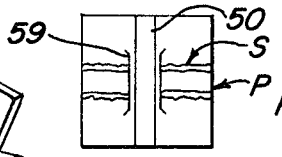
Figure 20:
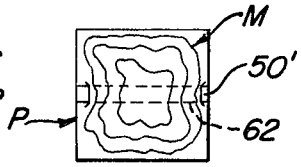
Figure 18:
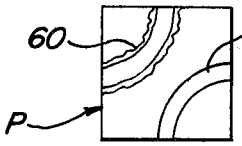
Figure 21:
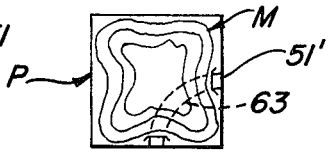

The special pieces P of FIGS. 16–21 include those illustrated in FIG. 16, having a road 50 across an overpass 58 crossing over a transversely disposed railway Y, those of FIG. 17 having a road 50 crossing over a stream S by means of a bridge 59, those of FIG. 18 having a corner curve 60 of a stream S and a curved road 51, those of FIG. 19 which includes a curve 61 of a railway and a curved road 51, those of FIG. 20 having the representation of a mountain thereon, together with a transverse road 50' which includes a tunnel 62 under the mountain, and those of FIG. 21 also having the representation of a mountain thereon but a 90° road 51' having a curved tunnel 63 under the mountain.

In one way of playing a game in accordance with this invention, all of the town pieces T and lake pieces L are placed face down with the circle 35 of each showing. The pieces are moved around to shuffle them. The road pieces R and the special pieces P are also placed face down and shuffled by moving around, but at a separate position from the town pieces T. One of the players is selected to be the "planner", for the purpose of placing the town pieces T and lake pieces L in face down position on random squares 30 of FIG. 2 and corresponding spaces of the remainder of the board. It will be noted that a town piece should not be placed on an outer edge space 31, or on a space 32 or 32' traversed by the railway Y, or on a space 33 or 33' traversed by the stream S, or on a space 34 on which the mountain M or the mountain M' or M'' is located. The planner is prohibited from placing two town pieces side by side, although two town pieces corner to corner is permitted, as well as on a space adjacent to the outer edge spaces of the playing board B. The duties of the planner terminate when the planner turns over one of the town pieces T, or a lake piece L, if the latter happens. In the meantime, the other players have drawn a suitable number of town pieces and special pieces, such as six, and placed them on a holder H for view by that particular player.

It is essential that, when a town piece T is turned over, the piece is to be turned as though the player were turning a page of a book or a page of a tablet, i.e., from side to side, or top to bottom, so that the relation of the roads extending from the town is maintained on one axis, but may be reversed on the axis transverse thereto. Depending on the position of the player relative to the board, i.e., on which side the player is located and depending on which of the above two methods are used, a town piece being turned over may become face up with the access roads in different positions. This adds an element of chance to the game, since points are scored by making a connection between two towns. Thus, a different position of an access road may produce a different relation of roads between towns, while another difference is when the town piece turned over is adjacent a square occupied by a stream S, a railway Y or a mountain M, M' or M'', since an access road pointing toward the stream, railway or mountain requires a particular special piece P to be played on the square crossed by the stream or railway, or occupied by the mountain.

After the planner has turned a town piece face up, play passes to the player on the planner's left, with play thereafter moving around in a clockwise direction. Thus, the player to the left of the planner turns up a second town piece and then attempts to play any of his pieces which he is able, in order to connect a road of a road piece to an access road of the town piece and to continue the road toward another town piece. If it happens that a town is next to a river or stream and an access road to that town ends at the square 33 traversed by the river or stream, the only piece which can be played on the square 33 to connect with the access road is the bridge and stream representation, special piece of FIG. 17. Similarly, for a town piece having an access road adjacent a space 32 over which the railway crosses, as turned up, a special piece having a railway overpass 58, as in FIG. 16, is the only piece which may be played on that square 33. Similarly, a special piece of FIG. 20 or 21 is the only piece which can be played on a square 34 occupied by a mountain M, M' or M'', in order to connect with an access road of a town piece adjacent the mountain. Also, a stream corner piece of FIG. 18 is the only piece which can be played on a stream corner space 33' and is not always playable thereon, since there must be a road to which the road 51 thereon can be connected. Similarly, a railway corner space 32' is the only place on which a railway corner piece of FIG. 19 is playable, although, again, there are requisite road locations on adjacent squares.

For scoring points, as indicated, any player who places a road piece which completes a road connecting two or more towns will be awarded the total sum of the access roads for each town so connected, as shown on the town piece T. In this connection, each road piece played must connect with any road extending to the space on which the road piece is played. Also, any road terminating at an edge of the road piece may extend to a blank square, but cannot extend to a blank side of an adjacent road piece or town piece.

Each additional player, in turn, starts his play by turning up one town piece, taking care that the town piece is turned over as in turning pages of a book or tablet, so that the directions of the road extensions, if any, are maintained along one axis. Each player, after turning up one town piece, plays as many road pieces or special pieces as he can or desires, while the total number of points scored is added to that player's score, when he succeeds in connecting two towns. When one player has finished playing, he should inform the next player, who can then turn up one of the town pieces in the prescribed manner. After informing the next player of the end of his play, each player whose turn has ended draws additional road pieces and special pieces to maintain six pieces on the holder H, as in FIG. 10.

A player may discard one road piece or special piece, but only one, at the end of his turn. Discarded road and special pieces shall be placed face up next to the edge of the board. Any player may play any of the discard pieces placed face up at the edge of the board and take advantage of any scoring produced by that play or a subsequent play.

There may be additional restrictions on play, such as including the following:

1. A road piece should not be played, so as to make it impossible for a road to be continued, except with the use of a dead end piece.

2. A road may not continue to any edge of the playing board.

3. A road piece may not be placed next to a face down town piece, but may be played after the town piece has been turned to a face up position.

4. When a road is next to a railway or stream or river and pointing toward it, a piece may not be placed on the other side of the railway or river which will block crossing of the railway or stream.

5. A road may not run into another road piece without a road connection.

6. A road which is not connected in some way to a town may not be built.

7. A dead end piece should not be played so as to block a town from further connection to another town by at least one road.

8. If a town is not connected by at least one road to any other town, loops cannot be built which prevent the first town from being connected to another town by at least one road.

9. A road should not be started which cannot be continued.

10. A player must, at his turn, play at least one piece or discard a piece, e.g. place it face up along an edge of the board.

11. A player who fails to draw additional pieces at the end of his turn must wait until the end of his next turn to draw any more pieces.

12. If one player forgets to turn a town piece face up at the start of his turn, the next player may turn two town pieces face up at the start of his turn.

13. When a player plays the final piece which connects two towns, his score is the sum of the numbers appearing at the access roads connected.

14. Once used for scoring, the points on any access road are used up and cannot be used again for scoring.

15. A player may score the total of two access roads of the same town piece by producing a loop connecting the two access roads.

16. No points are scored by connecting an access road of a town piece to a dead end road piece.

17. If a road piece has three or four roads, i.e., a side road, in the road connecting two town pieces, another town piece may be connected to that side road and thus to the town previously connected, but the score is only that of the access road of the new town piece.

18. Two or more road systems may be connected to score, but the score is 10 points for each town piece in the smallest system, or in each system, if the systems are equal.

19. When the planner is out of pieces and there are no more pieces to be drawn, the game ends and the player with the highest score wins.

Figure 22:
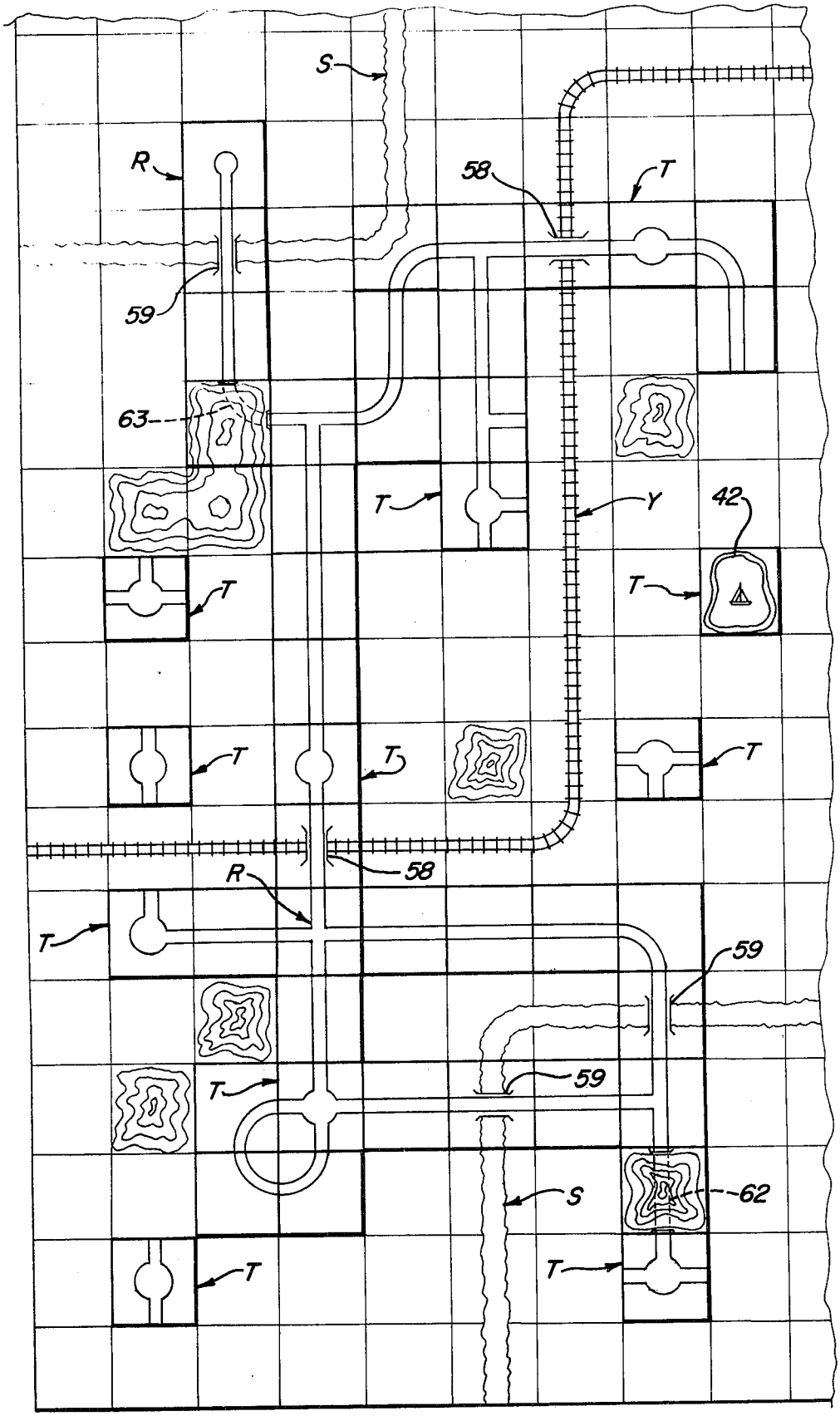
FIG. 22 is a top plan view of a portion of the playing board on which a number of pieces have been played.

An intermediate point in the play of the game of this invention is illustrated in FIG. 22, in which a number of town pieces T have been turned over, with one town piece being a lake 42, to which no roads can be connected. As shown, several of the town pieces have been connected together, while others remain to be connected. At the lower left is a town piece T not yet connected, while laterally and above it is a town piece T, all four of whose access roads have been connected, two of them by a closed loop. The connection for one of the access roads extends laterally across a stream S by means of a bridge 59 and the three-road piece is in turn connected by a tunnel 62 to a further town piece T, having two additional access roads yet to be connected. Another connecting road leads across a bridge 59 and thence to a road piece having four connecting roads, each of which is connected, with one being connected by a railway overpass 58 to an access road of another town piece T. Several town pieces are connected on the upper portion of FIG. 22, as well as one town piece to which no connection has yet been made and another town piece having two access roads adapted to be connected. Some of the connecting roads include a tunnel 63, a bridge 59 over a stream S and an overpass 58 for a railway Y. As will be evident, various other locations of town pieces may be made when placing them at random, while other combinations of different road pieces and town pieces may also be used.

It is believed evident that the game of this invention may be played by utilizing some of the road pieces R as pieces initially face down at random, as on the spaces 30 of the board. The road pieces which are to be utilized as initial pieces should be distinctive on the reverse side in some way, so that they will not be confused with the remainder of the road pieces. A different coloration or a distinctive mark, such as a ring 35 of FIG. 3, may be utilized. Again, the initially placed road pieces should be turned over in the same manner as turning the pages of a book or a tablet, so that the direction of the respective roads will remain the same for one axis, but will be reversed for the other axis. During play, the remainder of the road pieces, together with the special pieces P, will be played in the same manner, except that the scoring will need to be modified, since the basis of scoring will be essentially the playing of pieces to connect two initially played road pieces. A distinction between initial road pieces and those drawn is necessary when the road indicia on both pieces are showing. A different color provides a distinction on both the front and back, although a distinctive marking on the front of the initial road pieces may also be used. In scoring, the points may be scored for connecting between two initially placed road pieces, when face up, with the score made being the sum of the score for each of the two or more initial road pieces connected, as follows:

For connecting to the road piece of FIG. 15. . . 10 points.

For connecting to the road piece of FIG. 11 or FIG. 12. . . 10 points.

For connecting to the road piece of FIG. 13. . . 20 points.

For connecting to the road piece of FIG. 14. . . 30 points.

As will be evident, other rules similar to those for play utilizing the town pieces T as the initially placed pieces may also be adopted for play, when the initially played pieces are road pieces.

Although a preferred method of this invention has been illustrated and described and variations therein indicated, it will be evident that other variations may exist and that various changes may be made, all without departing from the spirit and scope of this invention.

What is claimed is:

1. A method of playing a game on a board divided into a plurality of playing spaces, with a first set of pieces having indicia representative of a function and which indicia represent extensions toward different edges of said piece for different groups of said set, and a second set of pieces having indicia representative of a function, related to the first said function and which indicia also represent extensions toward one or more sides of said piece, said first set of pieces and said second set of pieces including groups whose indicia representation extend toward different numbers of said sides, said method comprising:

placing at random a predetermined number of said first set of pieces face down on spaces of said playing board;

turning over individual pieces of said first set, during play, without disturbing one axis of rotation of the representation of said function;

playing pieces of said second set in abutting relation to pieces of said first set, with a side toward which a function representation extends abutting a side of a piece of said first set toward which a function representation extends; and playing additional pieces of said second set in similar abutting relationship, so as to connect two pieces of said first set.

2. A method as defined in claim 1, in which a physical characteristic is represented on some of the spaces of said playing board and a third set of pieces is provided with indicia representing one of such physical characteristics and also a function corollary to the function of said first and second sets, including:

playing pieces of said third set in abutting relation to pieces of said first or second set, on spaces of said playing board having a representation of the same physical characteristic and with the corrolary representation of a piece of said third set forming a continuation of a representation of said piece of said first or second set.

3. A method of playing a game on a board having playing spaces thereon, with a first set of pieces having directional indicia on one side and individually played on a space of said board, and a second set of pieces having directional indicia related to said directional indicia of said first pieces, whereby said directional indicia of said first pieces control the direction or position of playing said second pieces, including:

initially placing said first pieces at random on playing spaces of said board with said indicia downward; and turning over each said first piece on the same playing space without disturbing one axis of direction of said indicia.

4. A method of playing a game as defined in claim 3, wherein:

said first set of pieces have a central representation of a town and a representation of access roads leading from said town toward different edges of said piece for different groups of said first set.

5. A method of playing a game as defined in claim 4, wherein:

said second set of pieces have a representation of roads extending from the center of said piece toward different edges for different groups of said second set.

6. A method of playing a game as defined in claim 3, wherein:

said game board is provided with one or more representations of a limited physical characteristic of an area; and a third set of pieces are provided with indicia corresponding respectively to said physical characteristics and playable on spaces on which corresponding physical characteristics are represented.

7. A method of playing a game as defined in claim 6, wherein:

said third set of pieces have a representation of the respective physical characteristics on said board and a related function of said second set of pieces.

8. A method of playing a game as defined in claim 7, wherein:

said board is provided with a representation of streams, railways and mountains.

9. A method of playing a game as defined in claim 8, wherein:

said first set of pieces have indicia representative of a town disposed centrally and access roads extending toward different edges of said piece for different groups of said set; and said second set of pieces have a representation of roads extending from the center of said piece toward different sides of said piece for different groups of said set.

10. A method of playing a game as defined in claim 9, wherein:

said third set of pieces have representations including those of overpasses over railways, bridges over streams and tunnels through mountains.

* * * * *